United States Patent [19]

S terdal

[11] 4,218,188

[45] Aug. 19, 1980

[54] AXIAL FAN

[75] Inventor: Edgar Säterdal, Rottne, Sweden

[73] Assignee: Aktiebolaget Svenska Fläktfabriken, Nacka, Sweden

[21] Appl. No.: 905,028

[22] Filed: May 11, 1978

[30] Foreign Application Priority Data

May 17, 1977 [SE] Sweden ..... 7705826

[51] Int. Cl.[2] ..... F04D 29/36

[52] U.S. Cl. ..... 416/172; 416/146 A; 416/168 R

[58] Field of Search ..... 416/146 A, 157 R, 157 A, 416/157 B, 168 A, 168 R, 174, 205, 245 B, 172

[56] References Cited

U.S. PATENT DOCUMENTS

| | | | |
|---|---|---|---|
| 2,390,068 | 12/1945 | Adams et al. | 416/168 |
| 3,175,803 | 3/1965 | Newey et al. | 416/157 |
| 3,790,301 | 2/1974 | Pedersen et al. | 416/108 |
| 3,844,680 | 10/1974 | Saterdal | 416/157 |
| 3,920,353 | 11/1975 | Bredsted | 416/168 |
| 4,046,486 | 9/1977 | Kolb | 416/157 R |

FOREIGN PATENT DOCUMENTS

| | | | |
|---|---|---|---|
| 1019046 | 11/1957 | Fed. Rep. of Germany | 416/157 |
| 1011419 | 12/1965 | United Kingdom | 416/245 B |
| 1512560 | 6/1978 | United Kingdom | 416/146 A |

*Primary Examiner*—Everette A. Powell, Jr.
*Assistant Examiner*—A. N. Trausch, III
*Attorney, Agent, or Firm*—Fleit & Jacobson

[57] ABSTRACT

In an axial fan having an impeller with settable blades and wherein the root end of each blade connects, via a bearing permitting rotation of the blade, to the outer end of a blade-attachment shaft extending substantially radially relative to the impeller, the blade-attachment shaft is rigidly connected at its inner end to an impeller hub. The blade-attachment shaft is abutted against the radial outer side of the hub and is pre-tensioned by compressing said shaft in the longitudinal direction thereof against said hub.

7 Claims, 3 Drawing Figures

AXIAL FAN

The present invention relates to an axial fan having an impeller or fan wheel with settable blades, the root end of each blade connecting, via a bearing permitting rotation of said blade, to the outer end of a blade-attachment shaft extending substantially radially relative to the fan wheel, said shaft being rigidly connected at its inner end to a fan-wheel hub.

An axial fan according to the above is previously known, for example, from the U.S. Pat. No. 3,844,680 and has, inter alia, the advantage that the same hub construction and the majority of the means for adjusting the blade-angle can be used for fans of different sizes, whereby the fan manufacturer need only store a small number of different components in order to be able to deliver quickly axial fans of different sizes. In such axial fans, through-passing holes are arranged in a hub rim of the fan wheel for receiving the inner ends of the blade-attachment shafts. These holes weaken the hub rim and, similar to more conventional axial fans having the fan-blade shafts rotatably mounted in a hub rim, such as those fans illustrated in Swedish Published Specification No. 7400689-1, necessitate the use of a heavily-dimensioned hub rim which results in a heavy fan wheel. In addition hereto, the blade-attachment shafts in such axial fans are subjected to substantial tensile stresses as a result of the centrifugal forces occurring during operation, and hence these shafts must also be relatively sturdily dimensioned and are therewith heavy.

The object of the invention is to provide a novel and useful axial fan in which the aforementioned disadvantages are at least substantially eliminated.

To this end it is proposed in accordance with the invention that in an axial fan of the type described in the introduction each blade-attachment shaft is abutted against the radially outer side of the hub and is pre-tensioned axially by compression. In this way troublesome stresses on the blade-attachment shafts during operation of the axial fan are avoided in a simple and effective manner, as is also the provision of large, through-passing holes for receiving the blade shafts, which holes would weaken the hub.

Each blade-attachment shaft can be pre-tensioned and connected to the hub of the fan wheel by means of screws or the like having a head which acts against the radially outer end of the attachment shaft, passing freely through the attachment shaft and being screwed into screw-threaded holes in said hub. In this way, the provision of outwardly projecting construction elements for securing the blade-attachment shafts is avoided in a convenient manner, at the same time as the same means, namely screws, serve both to secure the shafts and to pre-tension the same.

In order to obtain blade-attachment shafts which are relatively light and which are highly resistant to bending, the attachment shafts may conveniently be tubular.

In accordance with an advantageous embodiment of the invention, each blade bearing is accommodated in a sealed bearing housing arranged to communicate with a chamber for a lubricating or protecting agent extending radially inwardly of the bearing housing in a manner such that lubricant or protecting agent is forced into the bearing housing by centrifugal forces created during operation of the fan. In this way, the blade bearings will operate under favourable conditions, thereby increasing the reliability of the axial fan and enabling the fan to be used under difficult operational conditions, for example for conveying hot gases. In this respect, when each blade-attachment shaft has the form of a tube, the interior of the tube may conveniently form said chamber, thereby obviating the need of expensive working operations for constructing the chambers.

To enable a single bearing to be used for each blade such as to ensure that the journal is reliable during operation of the fan, each bearing housing may conveniently be rigidly connected to an associated blade and surround the radially outer end of the blade-attachment shaft, said blade bearing comprising a thrust bearing located between a flange on the bearing housing directed radially inwardly in relation to the blade-attachment shaft, and a flange on the blade-attachment shaft directed radially outwardly in relation to said shaft. In this way, any play in the bearing will only slightly influence the precision of the fan wheel during operation, since the centrifugal forces acting on the blades urge the bearing tracks or sliding surfaces of the bearing towards each other thereby fixing the position of the blades. If play is present, however, the fan blades are able to tilt somewhat when the fan wheel is stationary. The fan blades, however, may be fixed in position in a simple manner even when the fan wheel is stationary by means of a spring arrangement adapted to co-operate with each blade and blade-attachment shaft in a manner such as to press said flanges, and therewith the tracks or sliding surfaces of the bearing, towards each other. In accordance with a preferred embodiment each said spring arrangement comprises a compression spring acting between a radially inward end surface on a blade and a radially outer surface on the blade-attachment shaft.

For the purpose of setting or changing the angular position of the blades, in accordance with an advantageous embodiment of the invention, each blade carries at its root-end a setting arm which projects radially outwardly in relation to the blade axis, which setting arm is connected, via a movement-transmission arm, to a setting device common to all said blades, which setting device for the purpose of changing the blade angle is displaceably mounted on the fan wheel for movement in the axial direction thereof and is also rotatably coaxial in relation to said fan wheel, one end of the movement-transmission arm being rigidly connected to the setting device and the other end of said arm being mounted for axial and universal movement in the associated setting arm. In axial fans in which the setting device is not rotatable relative to the impeller, the movement-transmission arms must be journalled both in the setting device and the setting arm. The bearings for the setting arms are subjected to high stresses which gradually result in play in these bearings, the negative effect of such play, in the form of deviations of the blade position from a position corresponding to a position given for the setting device, increases with the number of bearings required for the transmission of movement to each blade, at the same time as each additional bearing renders the construction more complicated. As a result of the arrangement proposed above there is required, however, only a single bearing for each movement-transmission arm, with a subsequent increase in precision and simplified construction. In order to further improve the precision and to increase the useful life of the setting-arm bearings, each setting arm is conveniently provided with a sealed bearing housing which accommodates a bearing adapted to journal the said other end of an associated movement-transmission arm, said bearing housing being arranged to communicate with a chamber for a lubricating or protecting agent extending radially inwardly of the bearing in a manner such that lubricant or protecting agent is forced into the bearing housing by the centrifugal forces created during operation of the fan. The construction can be simplified by providing a common chamber for lubricant or protecting agent for the bearing housings associated with one and the same blade. This is achieved with the minimum complication by arranging for the blade-bearing housing to communicate with the bearing housing in the associated setting arm, the last mentioned bearing housing communicating with said chamber via the blade-bearing housing.

An embodiment of the invention will now be described with reference to the accompanying drawings.

Figure 1:
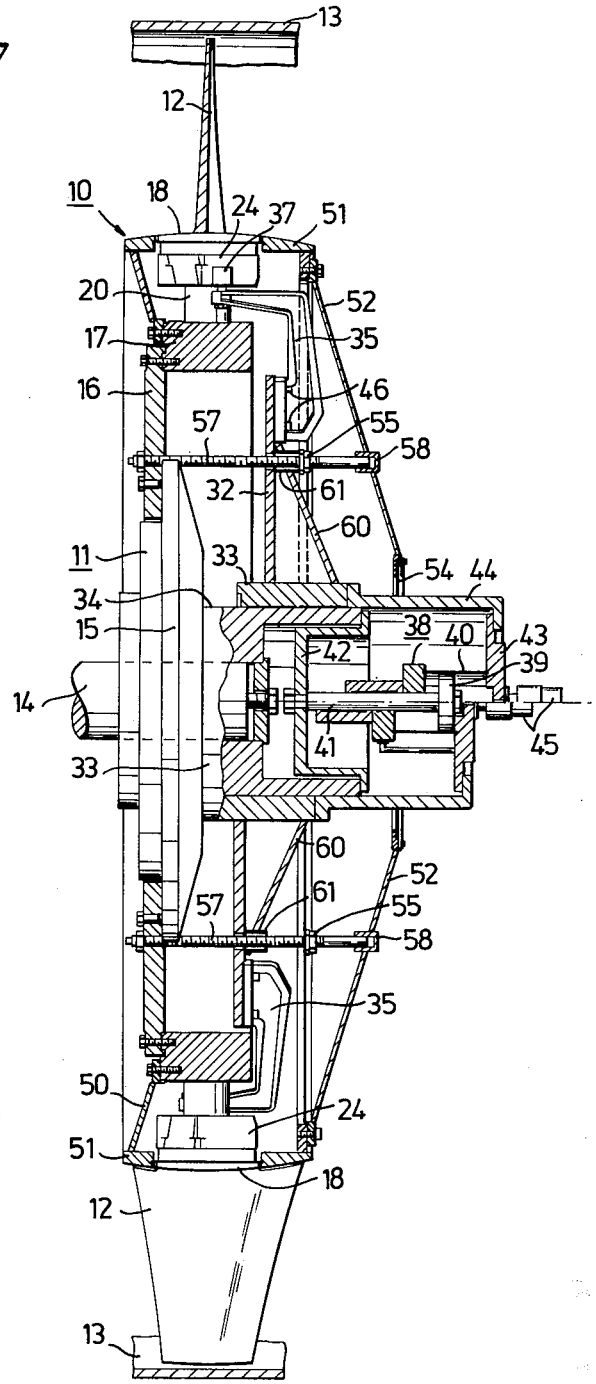
FIG. 1 is an axial sectional view of a fan according to the invention, the blades of the fan being illustrated in different setting positions in the upper and lower half of the Figure.

In the Figures of the drawing there is shown an axial fan having a fan wheel or impeller 10 having a hub 11 which carries settable blades 12. The fan wheel 10 is enclosed in a casing, as indicated at 13, and is rigidly mounted on the end of a shaft 14 which is connected to a drive motor, not shown, for rotating the fan wheel. The hub 11 includes a central part 15 whose periphery connects with a ring-shaped disc 16 which carries on the periphery thereof a hub rim 17.

Each blade 12 is provided with a circular root-part 18 which is rotatably connected, via a bearing 19 (FIG. 3) to the outer end of a blade-attachment shaft 20 extending radially relative to the fan wheel. Each blade-attachment shaft 20 is tubular and abuts at its radially inner end against the radially outer surface of the hub rim 17 in a shallow seating formed therein and is, furthermore, pre-tensioned axially by compression. The blade-attachment shafts 20, which exhibit cylindrical outer surfaces, are pretensioned and secured by means of screws 21 having heads which act against the radially outer end of associated attachment shaft 20 via a cover means 22 associated with an attachment shaft, said screws 21 passing freely through the associated attachment shaft and being screwed into threaded holes 23 arranged in the hub rim 17, the screws 21 being tightened to an extent such that the associated attachment shaft 20 obtains the desired degree of pretensioning.

Each blade bearing 19 is accommodated in a bearing housing 24 which is sealed against the root-part 18 of an associated blade 12 and against the outside of an associated blade-attachment shaft 20, which housing communicates, via an opening 25 in the cover means 22, with a lubricant chamber 26 located radially inwardly from the bearing housing relative to the fan wheel 10, said chamber 26 being formed by the interior of the tubular attachment shaft 20. To facilitate the introduction of lubricant into the lubricant chambers 26 there are provided channels 27 having nipples (not shown), and non-return valves or the like through which the desired lubricant pressure can be obtained and unintentional departure of lubricant through the passages 27 prevented. It will be understood that lubricant will be forced into the bearing housing 24 to lubricate the bearings 19 effectively therein under the influence of centrifugal forces occurring during operation of the fan and a possible overpressure in the chambers 26. Alternatively, the chambers 26 may be adapted to contain an agent other than lubricant and capable of protecting the bearings against deleterious physical and/or chemical effects from the gas being transported by the fan.

Each bearing housing 19 is held rigidly against the radially inner end surface of the root-part 18 of an associated blade 12 by means of screws or corresponding securing devices, not shown, and surrounds the outer end of an associated blade attachment shaft 20. In the illustrated embodiment, each bearing 19 is a thrust ball-bearing located between a flange 28 arranged on the bearing housing 19 and extending radially inwardly relative to the blade-attachment shaft and a flange 29 extending radially outwardly relative to the attachment shaft. The bearing 19 is localised by a cylindrical part of the cover means 22 in a manner such that it is located coaxially with the circular root-part 18 of the associated blade 12. Through the illustrated arrangement the blades 12 with associated root-part 18 and bearing house 24 will be urged radially outwardly by the centrifugal forces occurring during operation of the fan wheel 10, the flanges 28 on the bearing housings 24 urging the tracks and the bearing balls located therebetween in a direction towards the flanges of the cover means 22 in a manner such as to fix the position of the fan blade 12 such that no play can occur in the bearing during operation of the fan. When the fan wheel is stationary, the position of each blade is fixed by means of a spring device 30 which strives to urge the flanges 28, 29 towards each other. The spring device 30 comprises a compression spring of small diameter acting between a radially inner end surface of the blade 12 relative to the fan wheel and a radially outer end surface on the blade-attachment shaft 20. More specifically, the spring 30 is accommodated in a recess in the cover member 22. Thus, the spring 30 acts on the attachment shaft 20 via the cover member, and acts on the blade-root part 18 via the head of a self-locking screw 31 screwed into said part 18. The opening 25 in the cover member opens out into the recess accommodating the spring 30, a clearance or groove to enable lubricant to pass to the bearing 19 in the bearing housing 24 in the manner desired being located between the walls of the recess and the cover member 22 in general on the one hand and the spring 30, the screw head and the root part 18 on the other hand. By means of this arrangement lubricant is also passed to the spring device, the bottom of the recess and the screw head so that in this way, and because of the small contact area between the parts, minimum frictional forces occur upon rotation of the blades 12.

For the purpose of rotating the blades 12 in unison and for setting the blades to the desired pitch or angle there is provided a setting device which is common to all blades, said setting device comprising a circular setting plate 32 which is displaceable axially relative to the fan wheel 10. More specifically, the setting plate 32 exhibits a central, cylindrical part 33 which is coaxial with the fan wheel 10 and is mounted on a cylindrical part 34 of the central part 15 of the hub 11. The setting plate carries a plurality of movement transmission arms 35 extending between the plate and an associated blade, the end of each of said arms remote from the plate 32 being connected, via bearings 36 (FIG. 3), to a respective blade-setting arm 37 which is rigidly connected with the associated blade 12 and projects radially outwards relative to its axis of rotation, i.e. in a manner such that the bearing 36 is located at a radial distance from the axis of rotation of the associated bearing 19. The bladesetting arms 37 are formed as part of the bearing housings 24 and are connected to the root ends of respective blades 12 via said housings.

Axial movement of the plate 32, which normally rotates together with the fan wheel 10, is effected by means of a doubleacting pressure cylinder 38 having a piston 39 and a piston rod 41 projecting outwardly from the cylinder casing 40. The piston rod 41 is firmly connected at its outer end to the hub 11 via a connecting element 42, while the cylinder casing 40 is firmly connected, via elements 43, 44, to the central cylindrical part 33 of the setting plate 32. Connected to the pressure cylinder 38 in a known manner are means 45 for permitting the supply of working medium to one side of the piston 39 or the other during operation of the fan. The supply of working medium can be controlled during operation in a known manner such that the blades 12 are automatically held in positions in which the fan produces, for example, a constant flow of gas, a constant gas pressure etc.

The movement-transmission arms 35 are each rigidly connected at one end thereof to the plate 32 by means of attachment means 46, and are journalled in bearings 36 at their other end for both longitudinal and universal movement. More specifically, the movement-transmission arms 35 are provided at their journalled end with a shaft or peg 47 which is displaceably accommodated in a bore located in a universally moveable, substantially spherical bearing element, as will best be seen from FIG. 3. Further, the setting plate 32 is also rotatably mounted on the cylindrical hub part 34. When the plate 32 is displaced, the shafts or pegs 47 will move in an arcuate path around the axis of rotation of associated blades 12 during rotation of said blades. At the same time, the setting plate will move slightly around the hub part 34 and the shafts or pegs 47 will carry out a small rotary, tilting and axial movement in associated bearings 36.

Figure 3:
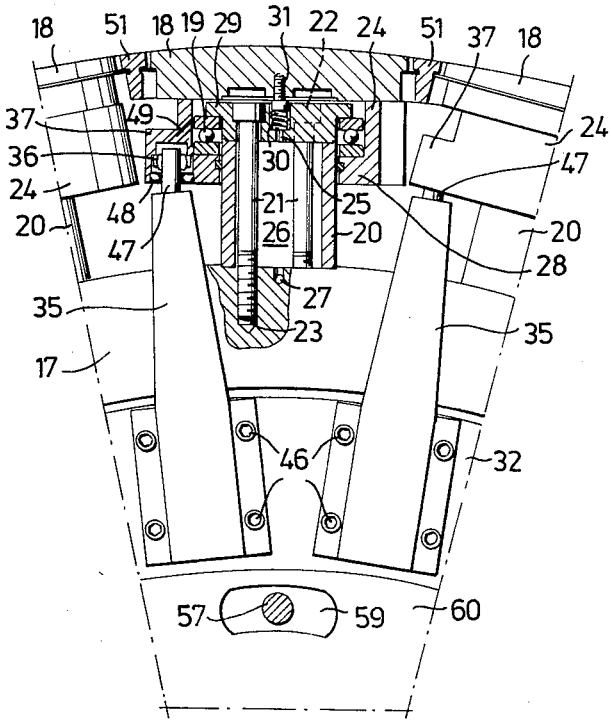
FIG. 3 is a partial end view, partly in section, of the fan shown in FIG. 1, a shield means having been removed in said Figure in order that the construction of the fan can be seen more clearly.

As illustrated in FIG. 3, the setting arms 37 are so constructed that they form bearing houses for the bearings 36, said bearing houses being sealed by means of seals 48 acting against the shafts 47. The bearing houses formed in the setting arms 37 communicate through channels 49 with the interior of the bearing houses 24 for the bearings 19, the channels 49 being so located that lubricant from the chambers 26 is forced, as a result of centrifugal force during operation of the fan, into the bearing houses of bearings 36 via openings 25 in the cover means 22, the bearing houses 24 and the channels 49.

Figure 2:
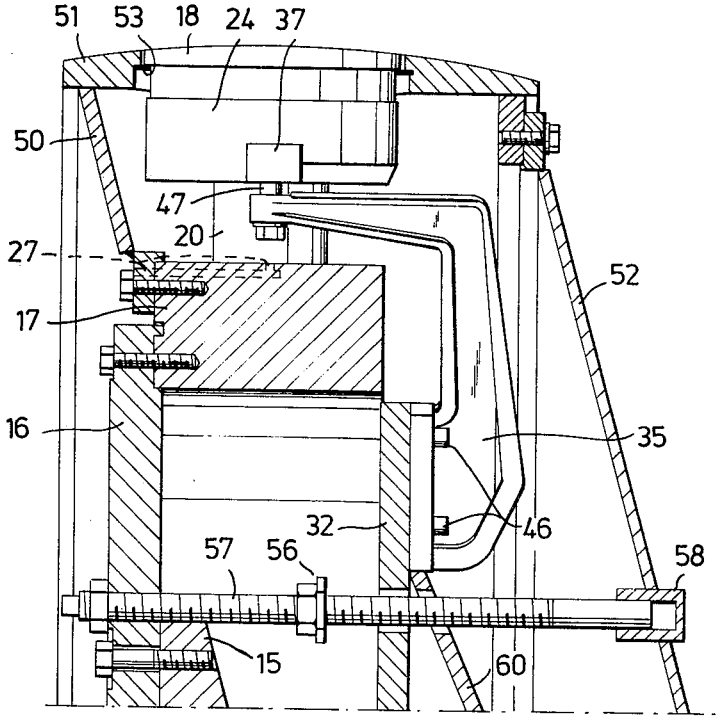
FIG. 2 illustrates in larger scale a portion of the axial sectional view of the fan according to FIG. 1 with the fan blade itself omitted.

For the purpose of shielding the more delicate components of the fan wheel 10 against the gases transported by the fan and for the purpose of, at the same time, producing favourable flow conditions in respect of these gases, the hub 11 has extending therefrom shield elements 50, 51 and 52. The shield element 51 comprises a circumferentially extending plate having circular holes which receive the root-parts 18 of the blades 12, the gaps between said holes and said root-parts, as will best be seen at 53 in FIG. 2, being sealed by means of sealing rings retained in grooves arranged in the defining walls of the holes. The shield element 52 carries at 54 a seal which is operative against the cylindrical element 44 which is axially moveable together with the plate 32.

For the purpose of adjusting the limit positions for the axial movement of the plate 32, and therewith the limit positions for rotation of the blades 12, stop shoulders 55 (FIG. 1) and 56 (FIG. 2) are arranged on opposite sides of the plate 32. In the illustrated embodiment the stop shoulders 55, 56 comprise nuts and washers axially settable on associated screw-threaded pins 57. The pins 57 are arranged in uniform angular distribution around the shaft 14 and at one end are axially adjustably connected with the hub part 16 and at their other end are guided in sleeves 58 in the shield element 52. The plate 32 at that part thereof where the pins 57 pass therethrough is provided with slots, as illustrated at 59 FIG. 3, which permit both displacement and rotation of the plates 32 relative to the axis of the fan wheel 10. In the illustrated embodiment, the plate 32 is guyed or supported by means of a reinforcing ring 60 which extends obliquely between said plate 32 and the part 33 and which is provided with holes for the pins 57 and with sleeves 61 against which the stops 55 can engage. These holes and sleeves have also an elongate or slot-like cross-section, which permits the requisite displacement and rotation of the plate 32.

The invention is not restricted to the described and illustrated embodiment thereof, but can be modified within the scope of the following claims. Thus, within the scope of the invention, the blade-attachment shaft can be abutted against the outer surface of the fan-wheel hub without axially pre-tensioning said shaft.

I claim:

1. An axial fan having an impeller with settable blades, the root end of each blade connecting, via a bearing permitting rotation of the blade, to an outer end of an axially-extending blade-attachment shaft extending substantially radially relative to the fan wheel, said shaft being rigidly connected at its inner end to a fan-wheel hub comprising a central hub portion mounted on a fan-wheel driving shaft, a hub rim, and hub rim mounting means extending substantially radially outwardly from said hub portion to the hub rim for rigidly interconnecting said hub portion and said hub rim, the blade-attachment shaft being abutted against the radially outer side of the hub rim and pre-tensioned in its axial direction by compression.

2. An axial fan according to claim 1, characterised in that each blade-attachment shaft is pre-tensioned and connected to the hub rim by means of screws or bolts having a head which acts against the radially outer end of the attachment shaft, passing freely through the attachment shaft and being screwed into screwthreaded holes in the hub rim.

3. An axial fan according to claim 1 or 2, characterised in that each blade-attachment shaft has the form of a tube.

4. An axial fan according to claim 3, characterised in that each blade bearing is accommodated in a sealed bearing housing which communicates with a chamber for a lubricating or protecting agent, said chamber being formed by the interior of the tube and extending radially inwardly of the bearing housing in a manner such that lubricant or protecting agent is forced into the bearing housing by centrifugal force during operation of the fan.

5. An axial fan according to claim 4, characterised in that each bearing housing carries a setting arm which extends radially outwardly relative to the blade axis, which setting arm is connected, via a movement-transmission arm, to a setting device common to all the blades, which setting device for the purpose of changing the blade angle is displaceably mounted on the fan wheel for movement in the axial direction thereof and is also rotatable coaxially in relation to the fan wheel, said movement-transmission arm being rigidly connected at one end thereof to the setting device and being journalled at its other end in the associated setting arm for both substantially radial movement relative to the fan wheel and universal movement.

6. An axial fan according to claim 5, characterised in that each setting arm is provided with a sealed bearing housing which accommodates a bearing for journalling said other end of the associated movement-transmission arm, and in that the bearing housing communicates with a chamber for lubricating or protecting agent, said chamber being formed by the interior of the tube and extending radially inwardly of the bearing in a manner such that lubricant or protection agent is forced into the bearing housing by centrifugal forces created during operation of the fan.

7. An axial fan according to claim 6, characterised in that the blade-bearing housing is arranged to communicate with the bearing housing in the associated setting arm, the latter bearing housing being arranged to communicate with said chamber via the blade-bearing housing.

* * * * *